US006706118B2

(12) United States Patent
Heink et al.

(10) Patent No.: US 6,706,118 B2
(45) Date of Patent: Mar. 16, 2004

(54) APPARATUS AND METHOD OF USING MOTION CONTROL TO IMPROVE COATWEIGHT UNIFORMITY IN INTERMITTENT COATERS IN AN INKJET PRINTER

(75) Inventors: Philip Jerome Heink, Lexington, KY (US); Royden Thomas Kern, Lexington, KY (US); David Starling MacMillan, Lexington, KY (US); Johnny Ray Sears, Midway, KY (US); Ronald Todd Sellers, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/083,722

(22) Filed: Feb. 26, 2002

(65) Prior Publication Data

US 2003/0161963 A1 Aug. 28, 2003

(51) Int. Cl.[7] ..... B05C 11/10

(52) U.S. Cl. ..... 118/697; 118/702; 118/763; 118/699; 118/704; 118/706

(58) Field of Search ..... 118/699, 702, 118/703, 704, 706, 635, 680, 682, 686, 697, 676, 674, 224; 162/265

(56) References Cited

U.S. PATENT DOCUMENTS

| | | | | |
|---|---|---|---|---|
| 2,288,720 A | | 7/1942 | Knowlton | |
| 3,222,209 A | | 12/1965 | Brundige et al. | |
| 3,301,156 A | | 1/1967 | Roeber | |
| 3,499,419 A | | 3/1970 | Bohmer et al. | |
| 3,647,525 A | | 3/1972 | Dahlgren | |
| 3,776,133 A | | 12/1973 | Ritzerfeld | |
| 3,885,066 A | | 5/1975 | Schwenninger | |
| 4,141,317 A | | 2/1979 | Lakhani | |
| 4,161,141 A | | 7/1979 | Lakhani | |
| 4,165,686 A | | 8/1979 | Borelli et al. | |
| 4,270,859 A | | 6/1981 | Galbraith et al. | |
| 4,354,851 A | | 10/1982 | Hix et al. | |
| 4,373,798 A | | 2/1983 | Tsukada et al. | |
| 4,382,262 A | | 5/1983 | Savit | |
| 4,449,476 A | * | 5/1984 | Voswinckel et al. | 118/674 |
| 4,478,505 A | | 10/1984 | Tashiro | |
| 4,503,802 A | | 3/1985 | Keller et al. | |

(List continued on next page.)

FOREIGN PATENT DOCUMENTS

| | | |
|---|---|---|
| EP | 0 726 156 A1 | 8/1996 |
| EP | 0 778 321 A2 | 6/1997 |
| EP | 0 822 094 A2 | 2/1998 |
| JP | Sho 63 299971 A | 12/1988 |
| WO | WO 99/64243 | 12/1999 |

*Primary Examiner*—Richard Crispino
*Assistant Examiner*—George R. Koch, III
(74) *Attorney, Agent, or Firm*—Tim Xia; Needle & Rosenberg PC

(57) ABSTRACT

A coating apparatus for applying a coating liquid to a printing substrate. The apparatus includes a rotatable first roll, and a rotatable second roll positioned adjacent to the first roll and defining with the first roll a first nip through which the printing substrate passes. The apparatus also has a metering device for applying a layer of coating liquid onto the second roll, which in turn transfers the coating liquid to the printing substrate. The apparatus further has a controller that communicates with at least the second roll, wherein the controller performs the steps of determining whether the idle time of the second roll is longer than a predetermined threshold, setting a pre-spin flag if the idle time of the second roll is longer than a predetermined threshold, and directing the second roll to perform a pre-spin upon the presence of the pre-spin flag.

14 Claims, 6 Drawing Sheets

U.S. PATENT DOCUMENTS 4,521,785 A 6/1985 Matsufuji
4,527,171 A 7/1985 Takanashi et al.
4,538,906 A 9/1985 Brown
4,599,627 A 7/1986 Vollert
4,643,130 A 2/1987 Sheath et al.
4,685,414 A 8/1987 DiRico
4,702,742 A 10/1987 Iwata et al.
4,704,615 A 11/1987 Tanaka
4,721,968 A 1/1988 Aral et al.
4,738,879 A 4/1988 Williams
4,766,840 A 8/1988 Beckley et al.
4,786,288 A 11/1988 Handa et al.
4,797,707 A 1/1989 Iwahashi et al.
4,838,985 A 6/1989 Karagiannis
4,839,200 A 6/1989 Hoffman et al.
4,949,131 A 8/1990 Ito
4,949,667 A 8/1990 Yoshida et al.
RE33,525 E 1/1991 Kohashi
5,006,862 A 4/1991 Adamic
5,034,777 A 7/1991 Ohezeki et al.
5,045,888 A 9/1991 Imaeda
5,075,153 A 12/1991 Malhotra
5,085,171 A 2/1992 Aulick et al.
5,107,788 A 4/1992 Boldrini et al.
5,116,148 A 5/1992 Ohara et al.
5,117,768 A 6/1992 Seymour
5,132,706 A 7/1992 Yuasa et al.
5,141,599 A 8/1992 Jahn et al.
5,178,678 A 1/1993 Koehler et al.
5,207,159 A 5/1993 DeMoore et al.
5,220,346 A 6/1993 Carreira et al.
5,230,926 A 7/1993 Narang et al.
5,255,023 A 10/1993 Bowlby, Jr. et al.
5,305,020 A 4/1994 Gibbons et al.
5,315,322 A 5/1994 Bannai
5,337,032 A 8/1994 Baker et al.
5,372,852 A 12/1994 Titterington et al.
5,396,275 A 3/1995 Koike et al.
5,403,358 A 4/1995 Aston et al.
5,406,356 A 4/1995 Campbell et al.
5,440,329 A 8/1995 Meggitt et al.
5,445,463 A 8/1995 Paranjpe
5,455,604 A 10/1995 Adams et al.
5,462,787 A 10/1995 Yamamoto et al.
5,500,668 A 3/1996 Malhotra et al.
5,500,724 A 3/1996 Campbell et al.
5,505,776 A * 4/1996 Pichler et al. ..... 118/203
5,512,930 A 4/1996 Brandt et al.
5,521,002 A 5/1996 Sneed
5,523,122 A 6/1996 Harada et al.
5,546,114 A 8/1996 Tait et al.
5,552,819 A 9/1996 Brandt et al.
5,561,454 A 10/1996 Kurabayashi et al.
5,563,644 A 10/1996 Isganitis et al.
5,582,087 A 12/1996 Crowley et al.
5,589,869 A 12/1996 Brandt et al.
5,614,933 A 3/1997 Hindman et al.
5,618,338 A 4/1997 Kurabayashi et al.
5,619,240 A 4/1997 Pong et al.
5,623,294 A 4/1997 Takizawa et al.
5,623,718 A 4/1997 Bracken et al.
5,628,827 A 5/1997 McCollam et al.
5,633,045 A * 5/1997 Smith et al. ..... 427/428
5,635,969 A 6/1997 Allen
5,645,888 A 7/1997 Titterington et al.
5,651,120 A 7/1997 Kitagawa et al.
5,676,363 A 10/1997 Kishida et al.
5,677,008 A * 10/1997 Kameya et al. ..... 427/428
5,677,067 A 10/1997 Kojima et al.
5,678,133 A 10/1997 Siegel
5,681,643 A 10/1997 Noguchi et al.
5,688,603 A 11/1997 Iqbal et al.
5,694,158 A 12/1997 Kato et al.
5,695,820 A 12/1997 Davis et al.
5,702,812 A 12/1997 Bracken et al.
5,708,943 A 1/1998 Applegate et al.
5,712,027 A 1/1998 Ali et al.
5,784,679 A 7/1998 Schlueter, Jr. et al.
5,797,318 A 8/1998 Taylor et al.
5,808,645 A 9/1998 Reeves et al.
5,825,378 A 10/1998 Beauchamp
5,827,577 A 10/1998 Spencer
5,882,131 A 3/1999 Belon et al.
5,908,505 A 6/1999 Bargenquest et al.
5,993,524 A 11/1999 Nagai et al.
6,002,909 A 12/1999 Furuyama et al.
6,094,557 A 7/2000 Shinohara
6,183,079 B1 2/2001 Meade et al.
6,444,270 B1 * 9/2002 Naruse ..... 427/359

* cited by examiner

APPARATUS AND METHOD OF USING MOTION CONTROL TO IMPROVE COATWEIGHT UNIFORMITY IN INTERMITTENT COATERS IN AN INKJET PRINTER

BACKGROUND OF THE INVENTION

1. Field of the Invention

The present invention generally relates to an apparatus and method for coating print media in an inkjet printer system. More particularly, the present invention relates to an apparatus and method that utilizes motion control to improve coatweight uniformity in intermittent coaters in a printer pre-coating apparatus related to an inkjet printer system.

2. Background Art

Drop-on-demand ink jet printers use thermal energy to produce a vapor bubble in an ink-filled chamber to expel a droplet. A thermal energy generator or heating element, usually a resistor, is located in the chamber on a heater chip near a discharge nozzle. A plurality of chambers, each provided with a single heating element, are provided in the printer's print head. The print head typically includes the heater chip and a nozzle plate having a plurality of the discharge nozzles formed therein. The print head forms part of an ink jet print cartridge that also has an ink-filled container.

The performance of ink jet printers have typically suffered from two major shortcomings. First, optical density of a printed image varies greatly with the print media or substrate being printed upon. Second, ink drying time sometimes may be excessive on some media types.

The performance of the ink jet printer is affected by interaction between the ink and print media or substrate influences. Different media types interact differently with the ink and not all media types are well suited for ink jet printing. Accordingly, attempts have been made to apply a liquid coating to the media before printing because the liquid coating consistently interacts with the ink no matter what type the printing media is, the quality of the resulting printed image can be improved. The ink may contain, for example, penetrants to improve dry time and binders to improve performance. These "precoating" liquids may contain materials that cause the ink to flocculate on the surface of the media, improving image quality. Precoating liquids have previously been applied to the print media using a separate ink jet print head and by the use of a roll coating apparatus that directly contacts the print media prior to ink application. One roll coating apparatus and method of the prior art is shown and described in U.S. Pat. No. 6,183,079, assigned to Lexmark International, Inc., which is incorporated herein by reference.

In such a system, as known to people skilled in the art, a fluid coating is applied to a printing medium such as a sheet of paper just prior to printing. Printers having pre-coating system may provide many advantages over conventional printers including the improvement of the optical density (or color saturation) of pigmented inks, reduction of color bleed, improved water-fastness, reduction of cockle and curl in the paper, and improved drying times.

One type of a pre-coating system utilizes a roll coating mechanism. Roll coating mechanisms have a long history and the technology is generally well known. Such systems, however, are almost exclusively used in a continuous mode.

Remedies for the non-uniformities and defects which arise from the starting, stopping, and idling during printing are not generally addressed because in a continuous system, they account for an acceptably small part of the total job.

Precoating systems of the prior art, however, suffer from several shortcomings. For example, ink jet precoating systems require that the precoating liquid have a sufficiently low viscosity to pass consistently through the print head. Such liquids typically have an undesirably long dry time and cause undesirable cockle and curl in the medium. Prior art roll coating precoating systems have not provided optimum control over the amount of precoating liquid applied to the print medium. Because the roll coater typically remains in contact with the medium during stop-start printing, coat weight irregularity, often referred to as "banding," has occurred in prior art roll coating systems. Banding frequently occurs when the rolls are stopped and the printer is depositing ink onto the substrate. During that time, coating remaining on the rolls may be absorbed by the substrate, resulting in a high coat weight at that location and a visible band. Severe banding may be aesthetically unacceptable and may disturb the interaction between the coating liquid and the ink.

One way to overcome the potential coatweight non-uniformity and defects that arise from the starting, stopping, and idling during printing is to utilize a "pre-spin" motion. That is, the rolls in a pre-coating system may be turned for some amount of motion time (or some equivalent angle or distance from the idle position) so that the fluid can be redistributed. Note that this motion ("pre-spin") would occur before the page is staged in the nip between the applicator and back-up rolls and so no paper would be in the system during this time. After the redistribution has occurred, the paper can then be staged in the nip between the applicator and back-up rolls and coating can begin. While this "pre-spin" eliminates most of the non-uniformities which occur as a result of the aforementioned flow of coating fluid, it causes another problem. The problem is that the coatweight on each of the rolls in the system will tend toward a different amount when the system is run without paper present than it would when there is paper present. If this "pre-spin" motion of the coater is too long, then other non-uniformities will occur on the coated page because the system equilibrates to different coatweights on its rolls when it runs without paper than when it runs with paper.

Accordingly, there is a need for an improved ink jet printer that is capable of printing images uniformly on a wide variety of commercially available substrates and wherein ink drying time is minimized and printed image quality is maximized.

SUMMARY OF THE INVENTION

The present invention, in one aspect, is a coating apparatus for applying a coating liquid to a printing substrate from a first paper path. The apparatus includes a rotatable first roll, and a rotatable second roll positioned adjacent to the first roll and defining with the first roll a first nip through which the printing substrate passes. The apparatus also has a metering device for applying a layer of coating liquid onto the second roll, which in turn transfers the coating liquid to the printing substrate. A controller communicates with at least the second roll, wherein the controller performs the steps, of determining whether the idle time of the second roll is longer than a predetermined threshold, setting a pre-spin flag if the idle time of the second roll is longer than a predetermined threshold, and directing the second roll to perform a pre-spin upon the presence of the pre-spin flag.

In one embodiment, the metering device includes a supply of coating liquid in contact with the second roll, and a doctor blade contacting the second roll for metering a layer of coating liquid onto the second roll. In another embodiment, the metering device includes a rotatable third roll contacting the second roll and forming a second nip therebetween, a supply of coating liquid in contact with the third roll, and a doctor blade contacting the third roll.

The coating apparatus can be associated with a printer. The controller thus can perform the steps of determining whether the printer is in a stand-by state, and directing the second roll to perform a pre-spin if the printer is in a stand-by state. The printer can have a second paper path to allow the printing substrate to bypass the first paper path. Accordingly, the controller further performs the steps of determining whether the printing substrate is in the first paper path, and directing the second roll to perform a pre-spin if the printing substrate is in the first paper path. Moreover, the controller further performs the steps of determining whether the printing substrate is in the first paper path, determining whether the printer is in a stand-by state, and directing the second roll to perform a pre-spin if the printing substrate is in the first paper path and the printer is in a stand-by state. In operation, the second roll performs the pre-spin at an optimal rotating angle to optimize the coat-weight uniformity of the coating liquid to the printing substrate, wherein the optimal rotating angle is substantially in the range of 360 to 720 degrees. Optionally, the apparatus may have a timer coupled to the controller. In one embodiment, the predetermined threshold is substantially equal to five (5) minutes.

In another aspect, the invention relates to a method for applying a coating liquid to a printing substrate. The method includes the steps of providing a coating device having a rotatable first roll, a rotatable second roll positioned to the first roll and defining with the first roll a first nip which the printing substrate passes, and a metering device for applying a layer of coating liquid to the printing substrate, determining whether the idle time of the second roll is longer than a predetermined threshold, setting a pre-spin flag if the idle time of the second roll is longer than a predetermined threshold, and directing the second roll to perform a pre-spin upon the presence of the pre-spin flag. The method further includes the step of applying a layer of coating liquid to the printing substrate.

In one embodiment, the coating apparatus is associated with a printer, the method includes the steps of determining whether the printer is in a stand-by state, and directing the second roll to perform a pre-spin if the printer is in a stand-by state.

In another embodiment, the coating device is associated with a printer, the printer having a first paper path and a second paper path to allow the printing substrate to bypass the first paper path, the method includes the steps of determining whether the printing substrate is in the first paper path, and directing the second roll to perform a pre-spin if the printing substrate is in the first paper path. The method further includes the steps of determining whether the printing substrate is in the first paper path, determining whether the printer is in a stand-by state, and directing the second roll to perform a pre-spin if the printing substrate is in the first paper path and the printer is in a stand-by state. The second roll performs the pre-spin at an optimal rotating angle to optimize the coatweight uniformity of the coating liquid applied to the printing substrate, wherein the optimal rotating angle is substantially in the range of 360 to 720 degrees.

In yet another aspect, the present invention relates to an apparatus for applying a coating liquid to a printing substrate from a first paper path. The apparatus has an applicator roll for applying the coating liquid to the printing substrate, and a controller means communicating with the applicator roll. The controller means performs the steps of determining whether the idle time of the applicator roll is longer than a predetermined threshold, setting a pre-spin flag if the idle time of the applicator roll is longer than a predetermined threshold, and directing the second roll to perform a pre-spin upon the presence of the pre-spin flag. In one embodiment, the apparatus is associated with a printer, and the controller means further performs the steps of determining whether the printer is in a stand-by state, and directing the applicator roll to perform a pre-spin if the printer is in a stand-by state. The printer may have a second paper path to allow the printing substrate to bypass the first paper path, and the controller means further performs the steps of determining whether the printing substrate is in the first paper path, and directing the applicator roll to perform a pre-spin if the printing substrate is in the first paper path. The controller means may further perform the steps of determining whether the printing substrate is in the first paper path, determining whether the printer is in a stand-by state, and directing the applicator roll to perform a pre-spin if the printing substrate is in the first paper path and the printer is in a stand-by state.

These and other aspects will become apparent from the following description of various embodiments taken in conjunction with the following drawings, although variations and modifications therein may be affected without departing from the spirit and scope of the novel concepts of the disclosure.

DETAILED DESCRIPTION OF THE INVENTION

Figure 1:
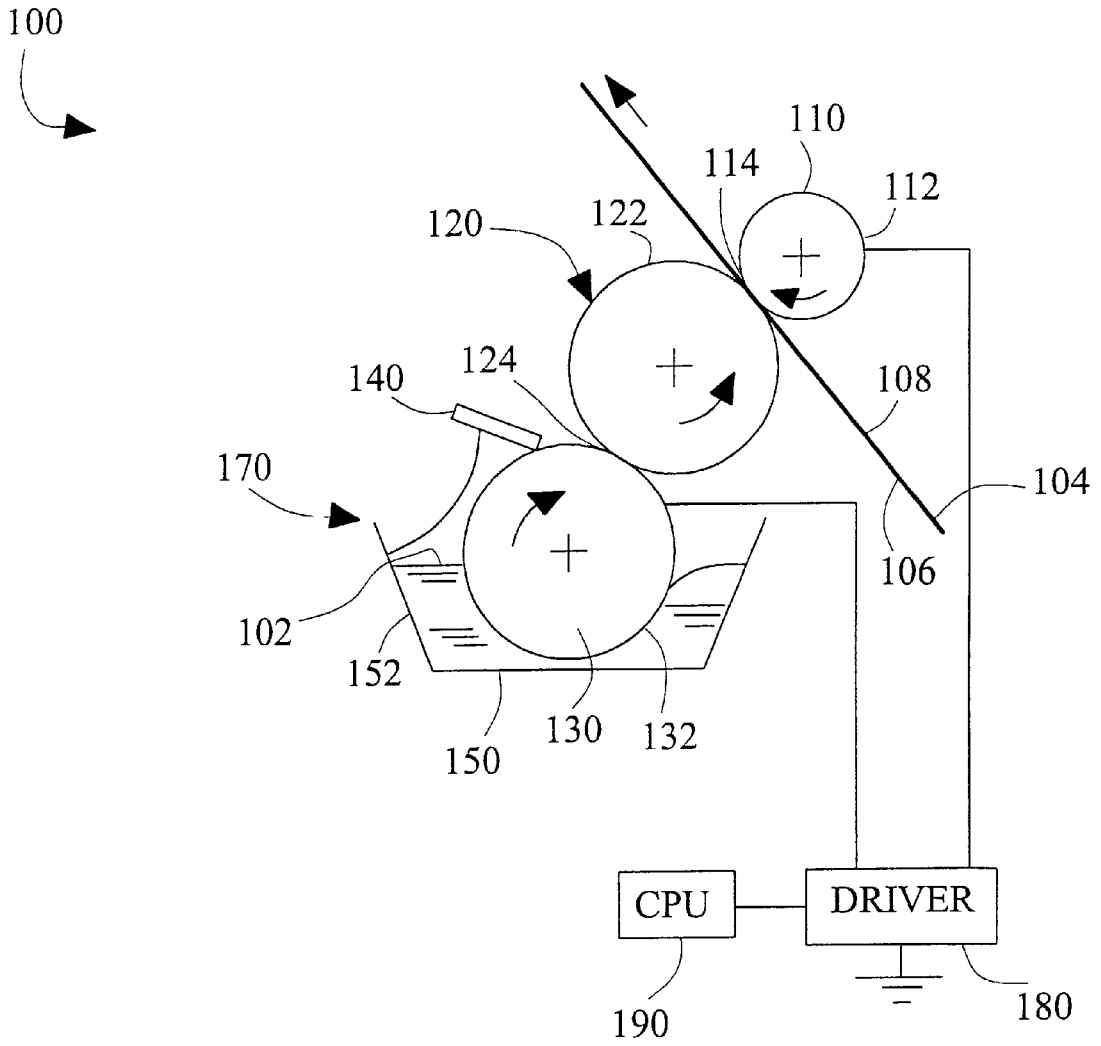
FIG. 1 is a side cross-sectional view of a coating apparatus according to one embodiment of the present invention.

Several embodiments of the invention are now described in detail. The disclosed embodiments are intended as illustrative only since numerous modifications and variations therein will be apparent to those skilled in the art. Referring to the drawings, like numbers indicate like parts throughout the views. As used in the description herein and throughout the claims that follow, the meaning of "a," "an," and "the" includes plural reference unless the context clearly dictates otherwise. Also, as used in the description herein and throughout the claims that follow, the meaning of "in" includes "in" and "on" unless the context clearly dictates otherwise.

The present invention, in one embodiment, is a coating apparatus 100 for applying a coating liquid 102 to a printing substrate 104. The coating apparatus can be utilized in a printer such as an ink jet printer (not shown). The printing substrate 104 can be a printing medium such as a sheet of paper. The substrate 104 has a front surface 106 that receives the coating liquid 102 and the printing ink, and an opposite rear surface 108. After coating, the printing substrate 104 may be transferred to a developing device for printing.

Still referring to FIG. 1, the coating apparatus 100 includes a rotatable first roll or back-up roll 110 and a rotatable second roll 120, where the second roll 120 is positioned adjacent to the first roll 110 and defines with the first roll 110 a first nip 114 between the first roll 110 and the second roll 120. The rotatable second roll 120 is often referred as an "applicator roll" in the art. Thus, as used in the description herein and throughout the claims that follow, the term of "second roll" is interchangeable with the term of "applicator roll." The first nip 114 allows the printing substrate 104 to pass through. The first roll 110 has an outer surface 112 and the second roller 120 has an outer surface 122. In one embodiment, the first roll 110 and the second roll 120 are substantially cylindrical.

Figure 1A:
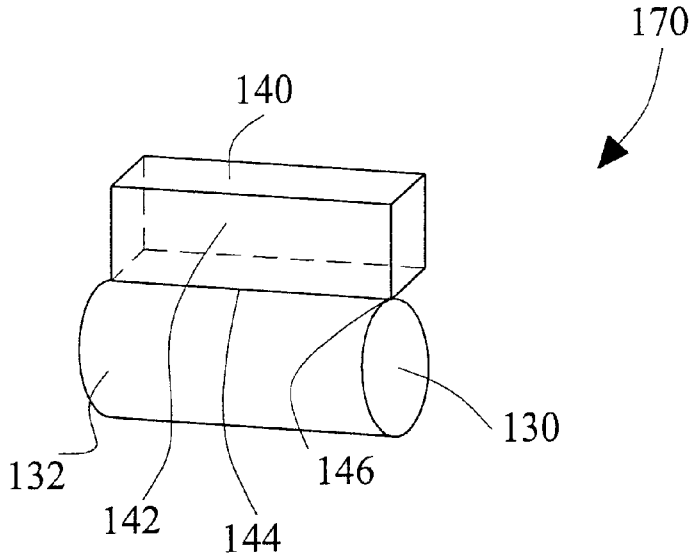
FIG. 1A is a partial perspective view of a metering device that can be utilized in the coating apparatus of FIG. 1 according to one embodiment of the present invention.

The coating apparatus 100 also has a metering device 170 for providing coating liquid to the second roll 120. In one embodiment shown in FIGS. 1 and 1A, the metering device 170 has a rotatable third roll or pick-up roll 130, a doctor blade 140 and a supply 150 of coating fluid 102. The third roll 130 is positioned adjacent to and in contact with the second roll 120 and defines with the second roll 120 a second nip 124 between the second roll 120 and the third roll 130. The third roll 130 has an outer surface 132 that has a relatively "rough" surface texture compared to the outer surface 122 of the second roll 120. For example, the third roll 130 can have a textured outer surface of grit-blasted aluminum. The doctor blade 140 has a substantially rectangular parallelepiped body 142 and a rectangularly shaped edge 144. The doctor blade 140 is positioned such that a corner 146 of the edge 144 bears on the outer surface 132 of the third roll 130. The supply 150 includes a trough 152 that contains coating fluid 102. Coating fluid 102 is provided to the trough 152 from a coating fluid reservoir (not shown).

A driver 180 can be utilized to activate the coating apparatus 100, in particular, the first roll 110 and the third roll 130. The driver 180 can also be utilized to activate the second roll 120. The driver 180 is coupled to a CPU or controller 190, which sends control signal to the driver 180. If the coating apparatus 100 is associated with a printer, the printer may have a controller to control itself and the coating apparatus 100. Thus, the controller 190 can be part of the printer or, alternatively, a separate device from the printer.

Figure 2:
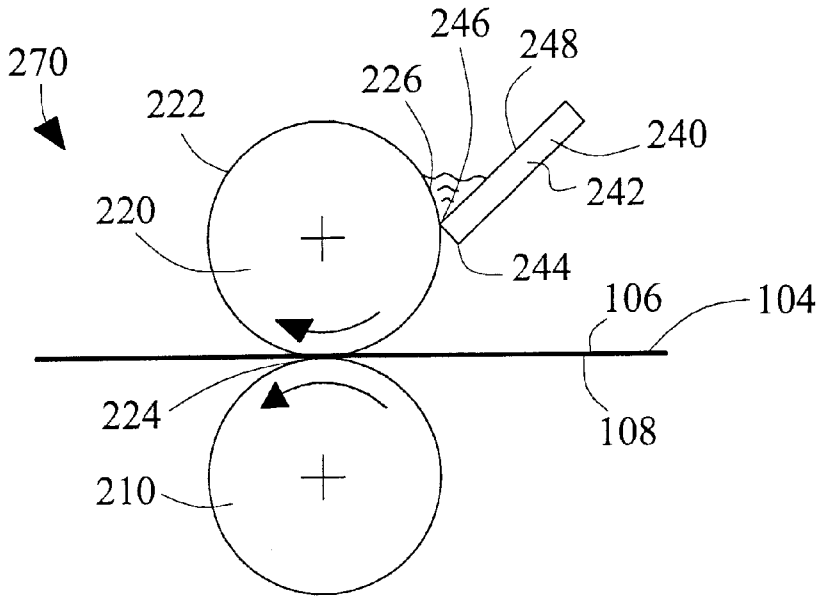
FIG. 2 is a side cross-sectional view of an alternative metering device that can be utilized in the coating apparatus of FIG. 1 according to one embodiment of the present invention.

FIG. 2 shows an alternative embodiment of the metering device 170 for providing coating liquid to the second roll 120. In FIG. 2, the metering device 270 has a doctor blade 240 and a supply 250 of coating fluid 202. The doctor blade 240 has a substantially rectangular parallelepiped body 242 and a rectangularly shaped edge 244. The doctor blade 240 is positioned such that a corner 246 of the edge 244 bears on the outer surface 222 of the second roll 220. A first side 248 of the substantially rectangular parallelepiped body 242 and a portion 226 of the second roll 220 define a coating liquid receiving trough 250. In this embodiment, the doctor blade 240 is in direct contact with the second roll 220 for metering a layer of the coating liquid 202 onto the second roll 220. In other words, no third roll is needed in this embodiment.

Figure 3:
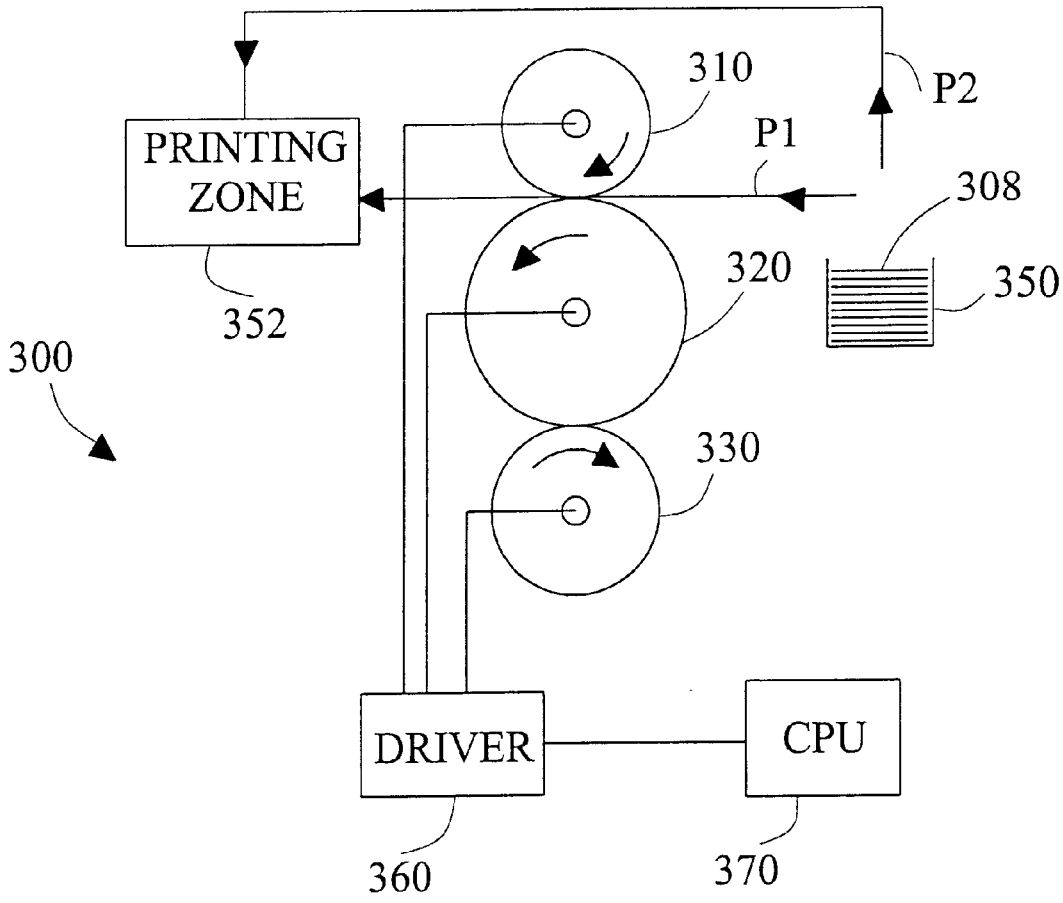
FIG. 3 is a sectional view of a coating apparatus according to one embodiment of the present invention.

Referring now to FIG. 3, a coating apparatus 300 has a first roll 310, a second roll 320 and a third roll 330 according to one embodiment of the present invention. The first roll 310, the second roll 320 and the third roll 330 can be activated to rotate by a driver 360, respectively, or in coordination. In this embodiment, the first roll 310 and the third roll 330 rotate in a first rotation direction, and the second roll 320 rotates in a second rotation direction that is opposite of the first rotation direction. The driver 360 is coupled to a CPU or controller 370, which sends control signal to the driver 360. The controller 370 communicates with the first roll 310, the second roll 320 and the third roll 330 and control their rotations, respectively, or in coordination, through the driver 360.

Figure 4:
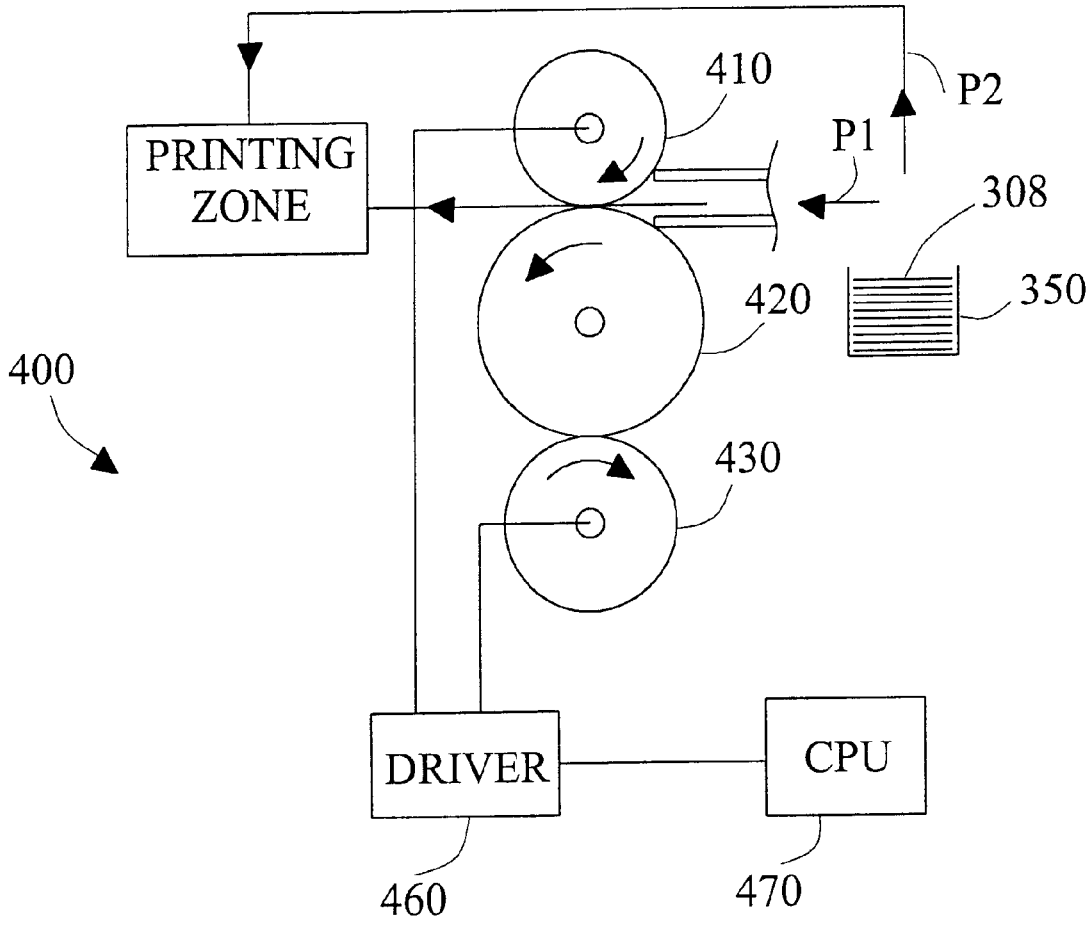
FIG. 4 is a sectional view of alternative coating apparatus according to one embodiment of the present invention.

Referring now to FIG. 4, a coating apparatus 400 has a first roll 410, a second roll 420 and a third roll 430 according to another embodiment of the present invention. The first roll 410 and the third roll 430 can be activated to rotate by a driver 460, respectively, or in coordination. In this embodiment, the first roll 410 and the third roll 430 rotate in a first rotation direction, and the second roll 420 rotates in a second rotation direction that is opposite of the first rotation direction. The driver 460 is coupled to a CPU or controller 470, which sends control signal to the driver 460. The controller 470 communicates, directly or indirectly, with the first roll 410, the second roll 420 and the third roll 430 and control their rotations, respectively, or in coordination, through the driver 460. In particular, the second roll 420 is not directly coupled to the driver 460. Instead, once the driver 460 receives an actuation signal from the controller 470, the driver 460 actuates the first roll 410, which in turn, through a mechanical coupling (not shown), provides a force to the second roll 420 to rotate in a rotation direction that is opposite of the rotation direction of the first roll 410.

Still referring to FIGS. 3 and 4, in normal operation, a printing medium such as a sheet of paper 308 from a supply 350 of papers is provided. Paper 308 can enter a path P1 that allows paper 308 to be coated prior to entering printing zone 352 for printing. Alternatively, paper 308 can enter a path P2 that allows paper 308 to bypass the coating apparatus 300 and move directly to the print zone 308 for printing.

Once a printing medium enters path P1, referring now to FIG. 1, the printing medium 108 subsequently enters the first nip 114, where coating liquid 102 is applied to the front surface 106 of the printing medium 108. In the illustrated embodiment, the printing medium 108 is fed to the first nip 114 such that the front surface 106 of the substrate 108 contacts the outer surface 122 of the second roll 120 and receives coating liquid 102 thereon. After the printing medium 108 passes through the first nip 114, the printing medium 108 is moved into a printing zone such as printing zone 352 in FIG. 3 for ink jet printing.

Figure 5:
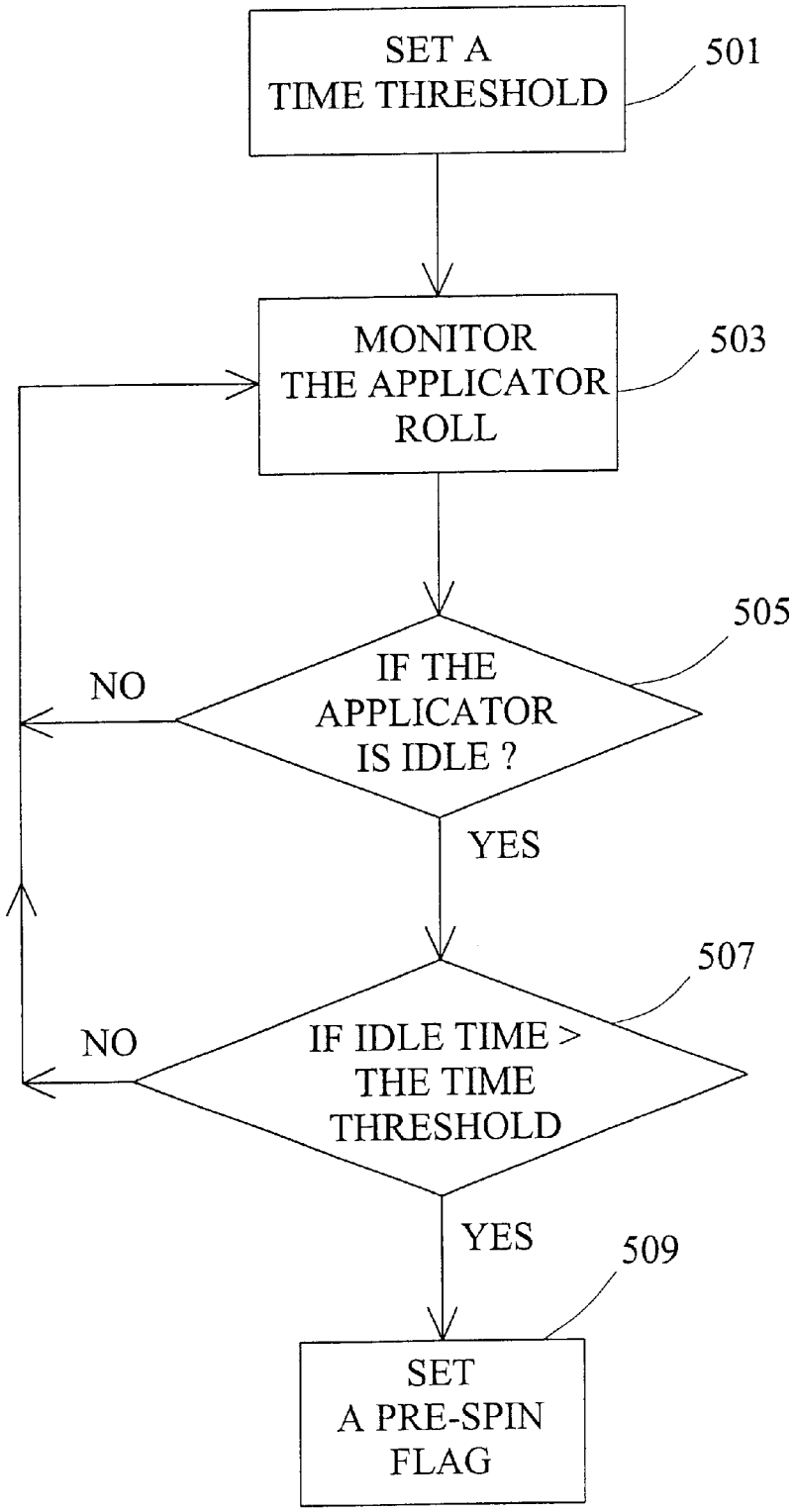
FIG. 5 is a flow chart showing a process for setting a pre-spin flag according to one embodiment of the present invention.

To avoid or minimize the non-uniformities and defects that may arise from starting, stopping, and/or idling during a printing job or printing jobs by a printer, in one aspect, the invention relates to a method for applying a coating liquid to a printing substrate by performing a pre-spin at a right time when the printer is at a particular state or states. In one embodiment, referring now to FIG. 5, a controller, such as controller 370 as shown in FIG. 3 or controller 470 as shown in FIG. 4, is utilized to create or set a pre-spin flag. In particular, at step 501, the controller sets a predetermined time threshold, which can be then stored in a memory device coupled to the controller and recalled each time when it is needed. The predetermined time threshold can be modified, reset or edited. A predetermined time threshold can be input into several printers. Alternatively, the predetermined time threshold can also be modified, reset or edited to a new value according to a particular printer. The predetermined time threshold for printer in normal operation can be chosen in the range of 1.0 minute to 15.0 minutes. In one embodiment, the predetermined time threshold is chosen as 5.0 minutes. At step 503, the controller monitors the status of the applicator roll. The status of the applicator roll can be classified as "normal" or "abnormal." In normal status, the applicator roll will be either in a state of printing (or "working") or in a state of stand-by (or "idle"). The controller at step 505 determines whether the applicator roll is idle. If no, the controller goes back to step 503 to continue to monitor the status of the applicator roll. If yes, at step 507, the controller determines whether the idle time of the applicator roll is longer than the predetermined threshold. The idle time of the applicator roll can be monitored and counted by a timer (not shown). The timer can be a part of the controller, or coupled to the controller. If no, the controller goes back to step 503 to continue to monitor the status of the applicator roll. If yes, at step 509, the controller sets a pre-spin flag. Thus, if the predetermined time threshold is chosen as 5.0 minutes, the controller will set a pre-spin flag whenever the applicator roll idles for 5 minutes or longer. For the sake of definiteness, clarity and as a concrete example, in the discussion below, the predetermined time threshold is chosen as 5.0 minutes with no intent to limit the scope of the present invention in any way.

The presence of a pre-spin flag determines whether a pre-spin will be performed. Nevertheless, according to one embodiment of the present invention, while a pre-spin can only be performed if a pre-spin flag is present, other condition or conditions are needed for the pre-spin to be realized. In other words, the flag is utilized to allow the controller to select an optimal time to perform a pre-spin rather than to immediately to initiate a pre-spin after every 5 minutes of idle time. This is because the status of the rest of the printer must be considered before executing a pre-spin such that performing a pre-spin does not adversely affect other operations of the printer. In particular, there are two distinct scenarios in which operations of the printer might be disrupted by a pre-spin. The first scenario is when a number of consecutive pages are being printed through a coating system. The operation of feeding paper through a coating path of the coating system, such as $P_1$ in FIG. 3, is optimized such that when the trailing edge of a page leaves a coating nip, such as the first nip 114 in FIG. 1, the next page is immediately staged to the nip. The next page is then held there until the previous page is out of the way so that the next page may be fed through the rest of the path. Many factors determine how long it will take for a page to be printed; therefore, it is possible for the applicator roll to be idle for more than 5 minutes with the next page staged in the nip as the previous page finishes printing. A pre-spin is therefore impossible for the next page because a paper (the previous page) is already present in the system.

The second scenario relates to where the printer contains a secondary paper path, such as $P_2$ as shown in FIG. 3, which bypasses the coating system for printing media that should not be coated. As known to people skilled in the art, a diverter (not shown) is often utilized to guide paper into an appropriate path, which is controlled by the motion of the coating system. For example, if the coating system turns in the forward direction, it also positions the diverter such that paper is directed toward the coating path. Thus, when the printer is operating in the non-coating path, the coating system may be idle for a long period of time. If a pre-spin were performed during this period, it would move the diverter into an improper position and guide the paper into an unintended paper path.

Figure 6:
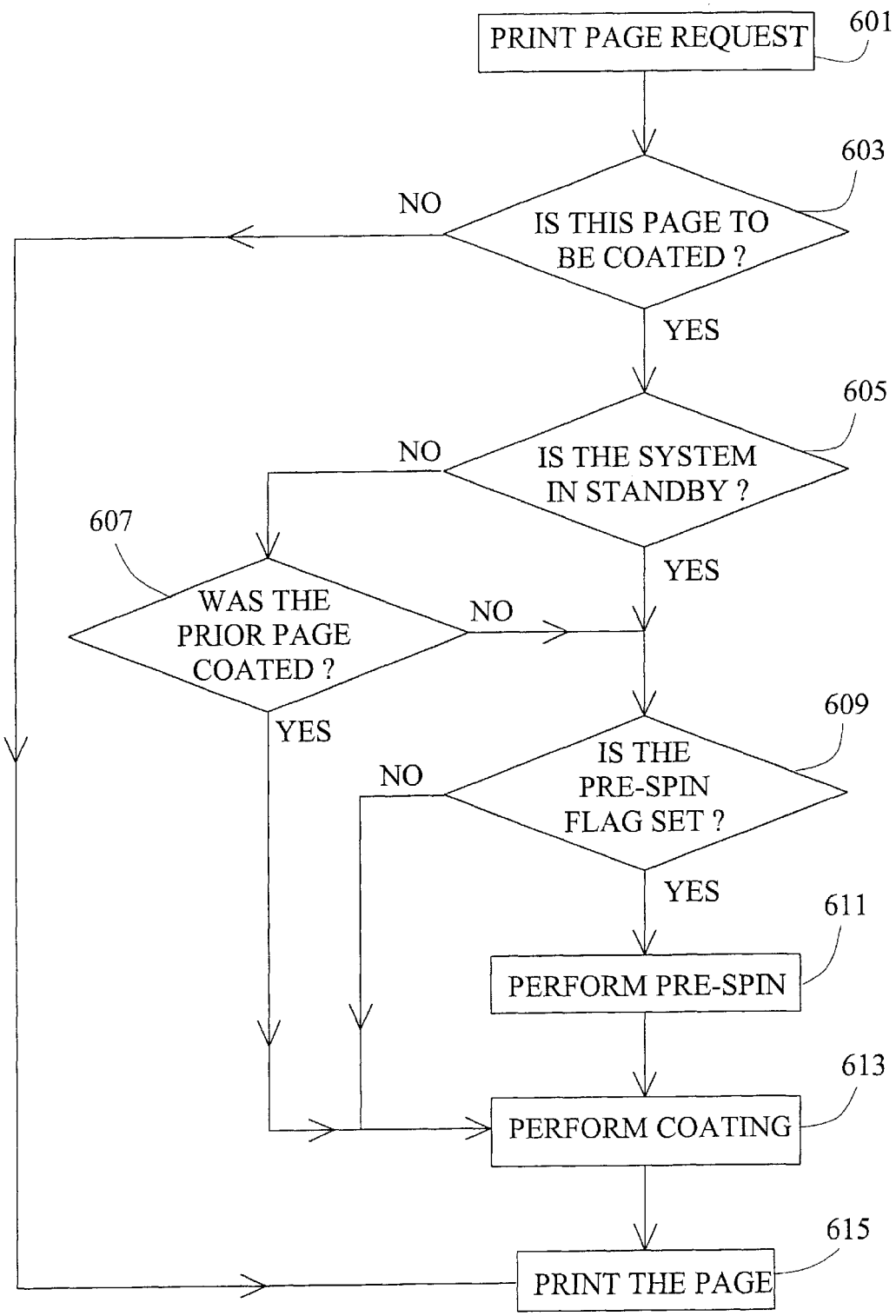
FIG. 6 is a flow chart showing a process for performing a pre-spin according to one embodiment of the present invention.

In order to avoid these and other scenarios, according to one embodiment of the present invention, the controller of the printer checks a number of conditions each time when it receives a print page request to determine if a pre-spin should be executed. In particular, referring now to FIG. 6, where a pre-spin control logic according to one embodiment of the present invention is schematically shown and will be described in connection with FIG. 3. In this embodiment, a coating device, such as the coating system 300 as shown in FIG. 3, is associated with a printer (not shown). The printer has a first paper path, such as $P_1$ as shown in FIG. 3, and a second paper path, such as $P_2$ as shown in FIG. 3, to allow a printing substrate such as a paper to bypass the first paper path. At step 601, the controller of the printer receives a print page request. At step 603, the controller determines whether the printing substrate is in the first paper path, i.e., whether the page is to be coated. If the page is not in the first paper path $P_1$, the page is not to be coated. The page will be in the second paper path $P_2$ and be routed directly to step 615 for printing. The printing can be performed in a printing zone 352. If the page is in the first paper path $P_1$, the page is to be coated.

Next, at step 605, the controller determines whether the printer is in a stand-by state. If not, the printer is in a printing mode, and as discussed above, a previous page may have been printing on. Thus, the controller further checks whether the prior or previous page is coated at step 607. If the previous page is coated, and the printer is finishing printing on the previous page, a pre-spin would be impossible because the previous page is being processed in the system. However, the current page should be coated. Thus, the current page will be directly routed to step 613 for coating. If the previous page is not coated, the current page will be directed to step 609 for further processing as discussed below.

On the other hand, if at step 605, the controller determines that the printer is in a stand-by state, which implies that a pre-spin may be performed. At step 609, the controller checks whether a pre-spin flag is present. If not, no pre-spin will be performed and the current page will be directed to step 613 for coating. On the other hand, if a pre-spin flag is present, the current page is directed to step 611 at which a pre-spin is performed. To do so, the controller directs the second roll or the applicator roll 320 to perform a pre-spin. The second roll 320 performs the pre-spin at an optimal rotating angle to optimize the coatweight uniformity of the coating liquid applied to current page, wherein the optimal rotating angle is substantially in the range of 360 to 720 degrees. Other ranges of rotating angle can be chosen according to a user's need. In one embodiment where the radius of the applicator roll 320 is about 1.0 cm, the rotating angle is chosen such that an optimal pre-spin corresponds to a rotation of the applicator roll having an equivalent move distance of about 97 mm by the peripheral surface of the applicator roll.

Once the pre-spin is performed, the controller directs the first roll and the second roll to apply a coating liquid to the current page at step 613. The coated page then is directed to step 615 for printing.

Note that the pre-spin motion of the applicator roll should be timed such that the coatweight uniformity (and corresponding print quality) is optimized. Having too small a pre-spin move leaves non-uniformities resulting from the coating fluid flow during the idle time. Too large a pre-spin move causes an excess coatweight on the top of the page which then diminishes as the page moves farther through the system. As discussed above, in one embodiment according to the present invention, the optimal pre-spin corresponds to an equivalent move distance of 97 mm by the peripheral surface of the applicator roll.

Thus, the coating apparatus and methods of this invention may improve the coatweight uniformity in a coating system associated with a printer that may start and stop frequently. Additionally, the coating apparatus and methods of this invention may be able to reduce non-uniformities which occur as a result of the apparatus being idling, i.e., when the rolls are not turning. Moreover, in addition to the specific applications described here, the coating apparatus and methods of this invention may may provide benefits in any roll coating system using a doctor blade to meter a coating fluid in which coatweight uniformity is desirable.

Although the present invention has been described with reference to specific details of certain embodiments thereof, it is not intended that such details should be regarded as limitations upon the scope of the invention except as and to the extent that they are included in the accompanying claims.

What is claimed is:

1. An apparatus for applying a coating liquid to a printing substrate from a first paper path, comprising:

a. a rotatable first roll;

b. a rotatable second roll positioned adjacent to the first roll and defining with the first roll a first nip through which the printing substrate passes;

c. a metering device for applying a layer of coating liquid onto the second roll, which in turn transfers the coating liquid to the printing substrate; and d. a controller communicating with at least the second roll, the controller performing the steps of:

(i). Determining whether the idle time of the second roll is longer than a predetermined threshold;

(ii). Setting a pre-spin flag if the idle time of the second roll is longer than a predetermined threshold; and (iii). Directing the second roll to perform a pre-spin upon the presence of the pre-spin flag.

2. The apparatus of claim 1, wherein the metering device comprises:

a. a supply of coating liquid in contact with the second roll; and b. a doctor blade contacting the second roll for metering a layer of coating liquid onto the second roll.

3. The apparatus of claim 1, wherein the metering device comprises:

a. a rotatable third roll contacting the second roll and forming a second nip therebetween;

b. a supply of coating liquid in contact with the third roll; and c. a doctor blade contacting the third roll.

4. The apparatus of claim 1, wherein the apparatus is associated with a printer and the controller further performs the steps of:

a. Determining whether the printer is in a stand-by state; and b. Directing the second roll to perform a pre-spin if the printer is in a stand-by state.

5. The apparatus of claim 1, wherein the apparatus is associated with a printer, the printer having a second paper path to allow the printing substrate to bypass the first paper path, and the controller further performs the steps of:

a. Determining whether the printing substrate is in the first paper path; and b. Directing the second roll to perform a pre-spin if the printing substrate is in the first paper path.

6. The apparatus of claim 5, wherein the controller further performs the steps of:

a. Determining whether the printing substrate is in the first paper path;

b. Determining whether the printer is in a stand-by state; and c. Directing the second roll to perform a pre-spin if the printing substrate is in the first paper path and the printer is in a stand-by state.

7. The apparatus of claim 1, wherein the second roll performs the pre-spin at an optimal rotating angle to optimize the coatweight uniformity of the coating liquid to the printing substrate.

8. The apparatus of claim 7, wherein the optimal rotating angle is substantially in the range of 360 to 720 degrees.

9. The apparatus of claim 1, further comprising a timer coupled to the controller.

10. The apparatus of claim 1, wherein the predetermined threshold is substantially equal to five (5) minutes.

11. An apparatus for applying a coating liquid to a printing substrate from a first paper path, comprising:

a. an applicator roll for applying the coating liquid to the printing substrate; and b. a controller means communicating with the applicator roll, the controller means performing the steps of:

(i). Determining whether the idle time of the applicator roll is longer than a predetermined threshold;

(ii). Setting a pre-spin flag if the idle time of the applicator roll is longer than a predetermined threshold; and (iii). Directing the second roll to perform a pre-spin upon the presence of the pre-spin flag.

12. The apparatus of claim 11, wherein the apparatus is associated with a printer, and the controller means further performs the steps of:

a. Determining whether the printer is in a stand-by state; and b. Directing the applicator roll to perform a pre-spin if the printer is in a stand-by state.

13. The apparatus of claim 11, wherein the apparatus is associated with a printer, the printer having a second paper path to allow the printing substrate to bypass the first paper path, and the controller means further performs the steps of:

a. Determining whether the printing substrate is in the first paper path; and b. Directing the applicator roll to perform a pre-spin if the printing substrate is in the first paper path.

14. The apparatus of claim 13, wherein the controller means further performs the steps of:

a. Determining whether the printing substrate is in the first paper path;

b. Determining whether the printer is in a stand-by state; and c. Directing the applicator roll to perform a pre-spin if the printing substrate is in the first paper path and the printer is in a stand-by state.

* * * * *